US010851319B2

(12) United States Patent
Wingren et al.

(10) Patent No.: US 10,851,319 B2
(45) Date of Patent: Dec. 1, 2020

(54) GASIFICATION SYSTEM AND METHOD

(71) Applicant: Meva Energy AB, Hisings Backa (SE)

(72) Inventors: Anders Wingren, Gothenburg (SE); Niclas Davidsson, Öjersjö (SE); Niklas Strandberg, Höviksnäs (SE)

(73) Assignee: MEVA ENERGY AB, Hsings Backa (SE)

( * ) Notice: Subject to any disclaimer, the term of this patent is extended or adjusted under 35 U.S.C. 154(b) by 0 days.

(21) Appl. No.: 16/339,314

(22) PCT Filed: Oct. 4, 2017

(86) PCT No.: PCT/EP2017/075234
§ 371 (c)(1),
(2) Date: Apr. 3, 2019

(87) PCT Pub. No.: WO2018/065472
PCT Pub. Date: Apr. 12, 2018

(65) Prior Publication Data

US 2020/0024531 A1 Jan. 23, 2020

(30) Foreign Application Priority Data

Oct. 7, 2016 (EP) ..... 16192928

(51) Int. Cl.
*C10J 3/48* (2006.01)
*C10J 3/72* (2006.01)
(Continued)

(52) U.S. Cl.
CPC ..... *C10J 3/487* (2013.01); *C10B 49/22* (2013.01); *C10J 3/723* (2013.01); *C10J 3/84* (2013.01);
(Continued)

(58) Field of Classification Search
CPC ... C10J 3/463; C10J 3/482; C10J 3/485; C10J 3/487; C10J 3/503; C10J 3/523;
(Continued)

(56) References Cited

U.S. PATENT DOCUMENTS 3,884,649 A * 5/1975 Matthews ..... C10J 3/86 48/202
3,998,606 A * 12/1976 Miyashita ..... C10J 3/08 48/71
(Continued)

FOREIGN PATENT DOCUMENTS

CN 101225315 A 7/2008
DE 102009047445 A1 6/2011
(Continued)

OTHER PUBLICATIONS

European Search Report for European Application No. EP 16 19 2928, titled: Improved Gasification System and Method, Date of Completion: Oct. 31, 2016.
(Continued)

*Primary Examiner* — Jonathan Luke Pilcher
(74) *Attorney, Agent, or Firm* — Hamilton, Brook, Smith & Reynolds, P.C.

(57) ABSTRACT

A gasification system and a method for gasifying a particulate carbonaceous fuel are disclosed. The gasification system has a gasification chamber with an upper section and a lower section with a fuel inlet for injecting a particulate carbonaceous fuel and oxidant into the upper section whereby, in a thermo-chemical reaction, synthesis gas and residual char is generated. The gasification system further includes a separator configured to receive the synthesis gas and to separate residual tar form the synthesis gas. Further, there is a char bed disposed in the lower section formed by residual char generated in the thermo-chemical reaction and a gas-inlet at a bottom portion of the lower section for injecting gas into
(Continued)

the char bed. The residual tar is injected into the char bed whereby, in a thermal cracking process, the residual tar is converted into synthesis gas. Hereby, it is possible to utilize the otherwise lost energy contained in the residual tar, and thereby achieve better efficiency in a gasification system, in a cost-effective and simple manner.

8 Claims, 3 Drawing Sheets

(51) Int. Cl.
*C10J 3/84* (2006.01)
*C10B 49/22* (2006.01)

(52) U.S. Cl.
CPC .. *C10J 2200/152* (2013.01); *C10J 2300/1603* (2013.01); *C10J 2300/1625* (2013.01); *C10J 2300/1628* (2013.01); *C10J 2300/1807* (2013.01)

(58) Field of Classification Search
CPC ..... C10J 3/54; C10J 3/84; C10J 3/845; C10J 2200/39; C10J 2300/0989; C10J 2300/1807; C10J 3/56; C10B 49/22
See application file for complete search history.

(56) References Cited

U.S. PATENT DOCUMENTS

| | | | | |
|---|---|---|---|---|
| 4,039,392 | A * | 8/1977 | Singh | C10B 49/22 202/93 |
| 4,057,402 | A * | 11/1977 | Patel | C10J 3/482 48/197 R |
| 4,146,369 | A * | 3/1979 | Flesch | C10J 3/54 48/201 |
| 2011/0005136 | A1 | 1/2011 | Möller | |
| 2014/0158941 | A1 | 6/2014 | Liu et al. | |

FOREIGN PATENT DOCUMENTS

| | | |
|---|---|---|
| EP | 3078727 B1 | 2/2018 |
| EP | 3305876 A1 | 4/2018 |
| JP | 5548288 B2 | 5/2014 |

OTHER PUBLICATIONS

International Search Report and Written Opinion for Int'l Application No. PCT/EP2017/075234, titled: Improved Gasification System and Method, dated Nov. 7, 2017.

* cited by examiner

GASIFICATION SYSTEM AND METHOD

This application is the U.S. National Stage of International Application No. PCT/EP2017/075234, filed on Oct. 4, 2017, which designates the U.S., published in English, and claims priority under 35 U.S.C. § 119 or 365(c) to European Application No. 16192928.6, filed on Oct. 7, 2016. The entire teachings of the above applications are incorporated herein by reference.

TECHNICAL FIELD OF THE INVENTION

The present invention generally relates to conversion of carbonaceous materials into desirable gaseous products such as synthesis gas. More specifically the present invention relates to a gasification system for gasifying carbonaceous material and a method thereof.

BACKGROUND

Gasification can be described as a process where organic or fossil fuel based carbonaceous materials are converted into a product gas of varying molecular weights, such as e.g. carbon monoxide, hydrogen and carbon dioxide. This is generally achieved through a thermo-chemical reaction where the carbonaceous materials react with a controlled amount of oxygen, steam and/or carbon dioxide acting as an oxidant, the resulting product gas mixture is often called synthesis gas (also known as synthetic gas or syngas).

The synthesis gas can later be used as a fuel gas where it is burned directly as fuel to produce heat and/or electric power or as an intermediate for other multiple uses. The power derived from gasification of bio-based feedstock is considered to be a source of renewable energy and the gasification industry has attracted a lot of interest during these last decades.

Further, gasification differs from other, more traditional energy-generating processes, in that it is not a combustion process, but rather a conversion process. Instead of the carbonaceous feedstock being wholly burned in air to create heat to raise steam which is used to drive turbines, the feedstock to be gasified is incompletely combusted to create the syngas which then at a later stage is completely combusted in order to release the remaining energy. The atmosphere within the chamber is deprived of oxygen, and the result is complex series of reactions of the "feedstock" to produce synthesis gas. The synthesis gas can be cleaned relatively easily, given the much lower volume of raw synthesis gas to be treated compared to the large volume of flue gases that need to be treated in conventional post-combustion cleaning processes. In fact, gasification processes used today are already able to clean synthesis gas beyond many environmental requirements. The clean synthesis gas can subsequently be combusted in turbines or engines using higher temperature (more efficient) cycles than the conventional steam cycles associated with burning carbonaceous fuels, allowing possible efficiency improvements. Synthesis gas can also be used in fuel cells and fuel cell-based cycles with yet even higher efficiencies and exceptionally low emissions of pollutants. The (energy) efficiency of a gasification system is often measured in terms of cold gas efficiency (CGE) which is the he ratio between the chemical energy in the product gas compared to the chemical energy in the fuel.

Nevertheless, even with the positive environmental aspects there is still a need for increased efficiency as well as a facilitation in terms of operation and maintenance.

The produced synthesis gas contains carbonaceous species that are generally classified as tars, such as e.g. naphthalene, antracene, indene, pyrene, etc. also referred to as polycyclic aromatic hydrocarbons (PAHs). These tars are very problematic due to their high viscosity and tendency to attach to any surface it comes in contact with and thereby clog piping or cause damage to other equipment. The problems associated with tar have caused a lot of concern in many gasification systems and it severely affects the operational reliability and the overall energy efficiency of the system.

There have been some attempts directed towards solving problems associated with residual tar and gasification processes, an example can be found in JP 55048288 which discloses a fuel gasification system. However, as many other prior attempts it includes using costly and in-efficient auxiliary equipment for handling both the residual char and residual tar, and moreover it relies upon combustion for disposal of the same.

There is therefore a need in the industry for a new and improved gasification system and method which is energy efficient but at the same time reliable and cost-effective.

SUMMARY OF THE INVENTION

It is accordingly an object of the present invention to provide a gasification system and a method for gasifying carbonaceous material which alleviates all or at least some of the above-discussed drawbacks of presently known systems. In more detail it is an object of the present invention to provide for a gasification system and method which is more cost effective and energy efficient compared to the prior art.

This object is achieved by means of a gasification system and method as defined in the appended claims.

According to a first aspect of the present invention there is provided a gasification system comprising:

a gasification chamber having an upper section and a lower section;

at least one fuel-inlet for injecting carbonaceous fuel and oxidant into said upper section whereby, in a thermo-chemical reaction, synthesis gas and residual char is generated;

a separator in fluid connection with the upper section via an outlet, said separator being configured to receive said synthesis gas and to separate residual tar from said synthesis gas;

a char bed disposed in said lower section, said char bed being formed by residual char generated in said thermo-chemical reaction and allowed to travel downwards within said gasification chamber to the char bed;

at least one gas-inlet at a bottom portion of said lower section for injecting gas into said char bed; and at least one tar inlet arranged to inject said residual tar from said separator into said char bed whereby, in a cracking process, said residual tar is converted into synthesis gas.

Hereby, a gasification system capable of efficiently handling the problems associated with residual tar components as well as utilizing the same to increase the energy efficiency of the complete system is presented. In more detail, the gasification system according to the first aspect of the present invention is less complex and more cost-effective as compared to known prior art solutions and efficiently utilizes the residual char from the thermo-chemical reaction to form a char bed which is in turn utilized to further increase the synthesis gas (syngas) output by means of a tar cracking process. The gasification system has a gas-inlet at the bottom portion of the lower section for injecting gas (oxidant) into the char bed in order to form an at least partly fluidizing/fluidized char bed. The oxidant (oxidizing agent) can for example be air, oxygen, carbon dioxide or steam while the carbonaceous particulate fuel can for example be one or more of the following: biomass, biofuel, coal, wood, agricultural residues such as e.g. husk, digestate, manure, dewatered waste water, barch, straw, peat, fibre residue.

The separator can for example be a scrubber (water or organic-liquid based, whereby the tar is subsequently separated by means of sedimentation, filtering, a centrifuge, etc.

The term in fluid connection is in the present context to be understood as there is a line/pipe between a first and a second point that is used to transmit liquids, or gas between the two points.

The gasification chamber is preferably cylindrically shaped and has a cylindrical inner wall/surface enclosing an internal cavity. Moreover, the inner wall of the gasification chamber can be at least partly curved, e.g. by being cylindrically shaped such that a part of said curved wall forms part of a cylinder. According to at least one embodiment, a cross section of said gasification chamber is circular, the cross section being in a plane perpendicular to a longituindal/elongated axis (z-axis in case of a cylindrical shape) of the gasification chamber. The lower section, may have an inner wall/surface with a tapered cylindrical (i.e. conical) character where a bottom portion has the smallest diameter, however, configurations where the gasification chamber has a more uniform character are also feasible, i.e. the upper section and the lower section may be arranged to have the same diameter. Further, the upper section and the lower section of the gasification chamber are preferably portions of a single vessel or container or at least in fluid connection with each other.

The present invention is based on the realization that a significant amount of fuel energy often remains in the residual tar and residual char after the thermo-chemical gasification reaction, and therefore wasted. Moreover, and as discussed in the background section of the present application, it is known that the residual tar components in the extracted synthesis gas tend to stick to surfaces and thereby cause unwanted problems. However, generally the tar cracking process needs high temperatures as well as high residence times, which can be problematic and difficult to achieve without sacrificing system efficiency or increasing cost.

Thus, the present inventors realized that by arranging a hot fluidizing char bed at the bottom section of the gasification chamber, formed by residual char produced in the thermo-chemical process, the overall energy efficiency can be increased. For example, many of the aforementioned unwanted problems associated with residual tar can be overcome by injecting the residual tar (after it has been separated from the produced syngas) into the hot fluidizing bed in order to thermally or catalytically crack the tar. Furthermore, the inventive system provides for the long residence time and the higher temperatures needed for efficiently cracking the residual tar without adding any complex and expensive auxiliary process steps to the gasification system.

The residual tar is contained in the synthesis gas that is produced at the upper section by the gasification (pyrolysis) process. The pyrolysis process can be said to be a process where volatile matter in the carbonaceous particulate material are released and converted to permanent gases, pyrolysis-oil and tar. Therefore, by utilizing the energy contained in the residual tar, energy efficiency of the overall gasification system can be increased and also many of the problems associated with the residual tar are overcome. In more detail, the efficiency is improved not only in terms of that a higher utilization ratio of the fuel is possible, but also in that the hot fluidizing char bed arranged at the bottom portion of the gasification chamber (i.e. within the same reactor) aids to maintain a sufficiently high temperature in the upper section of the gasification chamber for the first pyrolysis process to occur reducing the need for external heat sources or injection of excess oxidant. Additionally, by having both gasification processes occurring within the same chamber the whole system is made more compact and the need for tedious and expensive connection pipes between various reactors is diminished. Furthermore, the residual char is efficiently handled and utilized (for forming the hot fluidizing bed) whereby costs can be reduced since there is no need to lead off the extremely high temperature residual char particles, e.g. via the same outlet as the syngas is extracted, as in more conventional systems.

Accordingly, the gasification system may further comprise a syngas exit pipe arranged at a top portion of the gasification chamber, where the syngas exit pipe has an opening arranged the gasification chamber for receiving the synthesis gas. In other words, the syngas exit pipe defines the outlet.

Furthermore, by arranging the fluidizing char bed at the lower section of the gasification chamber, in which the residual tar is cracked, the efficiency of the system can be further increased. In more detail, no syngas (that is produced in the upper section) is used/wasted for cracking of the residual tar. This would be the case if the residual tar was cracked in the same section as the thermo-chemical pyrolysis process (upper section in this case), as opposed to prior art solution like for example in CN 101225315 where some of the generated syngas is used to crack tar components. The generated syngas is in such systems combusted in order to create the necessary "hot zone" for the tar cracking process. As briefly mentioned, the tar cracking processes needs high residency times and higher temperatures than the syngas producing process. Therefore it would consequently consume some of the produced syngas if the residual tar were to be cracked in the upper section of the gasification chamber.

In short it can be said that the gasification chamber according to the first aspect of the present invention has two different sections, namely the upper section and the lower section. These two sections may, to some extent, be referred to as a cold section and a hot section, respectively, where volatile matters in the carbonaceous fuel are gasified in the upper section (cold), and tar (and char) are gasified in the lower section (hot). Moreover, by having the hot section disposed below the cold section the system is made more energy efficient since the lower section helps to maintain a desired temperature at the upper section. Even further, the gasification system is configured to maintain the residual char within the gasification chamber after the thermo-chemical reaction in order to form a char bed at the lower section with the residual char. Thus, the residual char is kept from exiting the same outlet as the generated/produced synthesis gas by controlling the injection parameters of the injected fuel and/or the gas at the bottom gas-inlet. This diminishes the need for handling the often extremely hot residual char in any piping connected to the outlet which reduces the cost of the gasification system. Accordingly, the gasification system may further comprise a supporting surface (e.g. a perforated grate) arranged at the bottom portion of the gasification chamber arranged to support a formation of the char bed in the lower section of the gasification chamber. The supporting surface may be movable (e.g. axially) in order to remove residual ashes from the bottom of the char bed.

Even further, the present invention relies on gasification without combustion of the carbonaceous particulate fuel, as opposed to many known prior solutions, where combustion is included in at least one process step. Thereby, i.e. by having a low level of combustion of the carbonaceous fuel in a gasification process, the cold gas efficiency can be increased. According to an embodiment, the particulate fuel comprises particles with a particle size of less than 3 mm and a moisture ratio of not more than 30 wt %. For example, 80% or more of the particulate fuel comprises particles with a particle size of less than 3 mm and a moisture ratio of not more than 30 wt %. According to another embodiment, additional substance besides oxidant and particulate fuel, such as e.g. catalysts or inert substance or e.g. sand or carbon dioxide, are injected into the upper section via the at least one fuel inlet or a secondary inlet.

Yet further, in accordance with an embodiment of the present invention, the gas injection through said least one gas-inlet is arranged such that an injection velocity of said injected gas is controlled (or limited) such that a fluidization of said char bed does not disrupt a balance between the downwardly directed travelling of residual char from said upper section and upwardly directed flow of gas within the gasification chamber.

It is to be understood that the terminology "disrupt a balance between the downwardly and upwardly directed flows" is to be interpreted as, that the gas (oxidant) injection through the gas inlet at the bottom is used to control the flow balance (within the chamber) such that no residual char (which is traveling down by gravitational force within the gasification chamber towards the lower section) is pushed upwards by the upwardly directed flow of the injected gas.

This also enables the injection of light weight carbonaceous particulate fuel, while still being able to form a (fluidizing/fluidized) char bed at the bottom from the residual char generated in the thermo-chemical process. In an embodiment of the invention, the gas injection through the at least one gas-inlet is arranged such that an upwardly directed gas velocity of gases within the chamber is in the range of 0.1 m/s to 2.0 m/s whereby a fluidization of said char bed does not disrupt a balance between the downwardly directed travelling of residual char from said upper section and upwardly directed flow of said injected gas. The inlet can be arranged to maintain the upwardly directed gas velocity of gases within the gasification chamber within the predefined interval by e.g. controlling the injection velocity at the at least one gas inlet, size of the injection port of the at least one gas inlet, number of injection ports, etc.

The term "gas velocity" is in reference to the gas traveling within the chamber, and not to the injection velocity of the gas, as this is most often higher and depends on various structural details such as e.g. size and shape of the gas inlet which can be varied depending on desired specifications or applications.

The gas velocity is at least partly set or limited based on the dimensions and general structure of the gasification chamber and can be regulated by the injection velocity into the gas inlet at the bottom section. In other words, the gas injection velocity is controlled in order to keep the upwardly and downwardly directed flows in balance such that the bed material (residual char) of the fluidizing char bed isn't scattered upwards within the chamber. Hereby the residual char, generated from the thermo-chemical gasification/pyrolysis process in the upper section of the gasification chamber, is allowed to travel downwards toward the lower section and to form the (fluidized) char bed.

Further, in accordance with yet another embodiment the carbonaceous fuel is a solid particulate carbonaceous fuel, and the upper section of the gasification chamber has a curved inner surface, and wherein the solid particulate carbonaceous fuel and the oxidant are (concurrently) injected into the upper section tangentially such that a entrained flow of the synthesis gas is formed and whereby residual char is separated and allowed to travel from the upper section down towards the lower section in order to form the char bed.

In more detail, in this embodiment, the gasification reactions occurs in a dense cloud of fuel particles that is blown into the gasification chamber where it forms a swirling stream or flow, i.e. a vortex or a whirl, spinning down the reactor. These types of gasification chambers are often referred to as entrained flow reactors or entrained flow gasifiers (such as e.g. cyclone reactors/gasifiers). The term "entrained flow" is in reference to a concurrent injection (or feeding) of the carbonaceous fuel particles and the oxidant, where the oxidant flow can for example act as a carry for the fuel particles. In other words, in this embodiment the carbonaceous particulate fuel and oxidant are injected tangentially and concurrently into the gasification chamber. The swirling stream is established by a combined effect of fuel injection parameters, the entrained flow gasifier design and the force of gravity. For example, the rate of which the fuel is injected into the gasifier (i.e. the velocity of the injection stream), the inner shape of the gasifier, the diameter of the inlet and the inner diameter of the gasification chamber are parameters effecting the swirling flow. Moreover, this embodiment provides an advantageous effect in that it allows for a combination of gasification and separation, i.e. gasification of the fuel and separation of the ashes. In more detail, it provides a simple and efficient means for separating the residual char from the produced synthesis gas within the gasification chamber, whereby the residual char can subsequently be aggregated/collected at the lower section in order to form the (fluidized) char bed. The residual char particles in the rotating stream have too much inertia to follow the tight curve of the stream within the gasification chamber, thus, the residual char particles strike the wall or inner surface of the chamber and subsequently fall to the lower section of the entrained flow (e.g. cyclone or whirl) within the gasification chamber. The particulate fuel and oxidant are preferably injected into the upper section at a velocity within the range of 20 m/s to 150 m/s, more preferably within the range of 40 m/s to 130 m/s and most preferably within the range of 60 m/s and 100 m/s.

Moreover, an entrained flow gasifier, such as e.g. a cyclone gasifier, is specifically suitable for use with pulverized fuel, whereby the high flow of oxidant can act as a "carry" of particulate feedstock into the gasifier.

According to yet another embodiment of the present invention the gasification chamber further comprises a set of temperature control inlets spatially separated and distributed along a length, extending between the lower section and the upper section, of the gasification chamber, wherein the set of temperature control inlet(s) is/are configured to inject gas into the gasification chamber whereby a process temperature within different zones of the gasification chamber is controlled.

This provides for an efficient and simple means for controlling the process temperature at various sections or stages of the gasification chamber, for example, in order to maintain the temperature gradient (decreasing upwards) from the char bed at the lower section to the upper section. The injected gas can for example be air or any oxidant. Spatially separated and distributed along a length, extending between the lower section and the upper section, of the gasification chamber is in the present context to be understood as being serially arranged in a side-wall of the gasification chamber from a top to a bottom of the gasification chamber. For example, the gasification chamber may comprise a temperature control inlet arranged at the upper section, a temperature control inlet at the lower section and a temperature control inlet at a mid section (between the upper section and the lower section). The temperature control inlets are preferably individually controllable in terms of injection rates for the injected gas.

The temperature control inlets may be configured to maintain a temperature at the upper section of the gasification chamber in the range of 800° C. to 1100° C., and to maintain a temperature of the (at least partly fluidized) char bed at the lower section in the range of 1200° C. to 1500° C.

Even further, in accordance with yet another embodiment of the invention at least one fuel inlet comprises a feeding device for injecting said solid particulate carbonaceous fuel into the upper section, and wherein the gasification system further comprises at least one oxidant inlet, separate from the at least one fuel inlet, for injecting oxidant into the gasification chamber.

The feeding device may for example be a feeding screw or a feeding pump which can be used as an alternative to or in combination with entrained flow injection/gasification. Moreover, by using a feeding device such as a feeding screw, liquid carbonaceous fuels (as well as solids) may be injected into the gasification chamber.

Thus, the gasification system may be provided with at least two oxidant inlets spatially separated and distributed along a length, extending between the lower section and the upper section, of the gasification chamber, for injecting oxidant into the gasification chamber. Moreover, a rate of injected oxidant into said gasification chamber from the at least two oxidant inlets can be individually controllable.

Even further, by further having at least two separate oxidant inlets with individually controllable injection rates, the temperature profile of the gasification chamber may be controlled. For example, a higher amount of oxidant can be injected at an oxidant inlet arranged at the a lower position (closer to the char bed) of the gasification chamber as compared to an oxidant inlet arranged at an upper position, whereby a temperature profile of the gasification chamber is efficiently controlled, i.e. warmer/hotter towards the bottom of the gasification chamber. In other words, spatially separated along a length (or vertical axis) is to be interpreted as spatially separated and distributed along a (vertical) length of the gasification chamber, albeit not necessarily along a straight line.

The oxidant inlets may be configured to maintain a temperature at the upper section of the gasification chamber in the range of 800° C. to 1100° C., and to maintain a temperature of the (at least partly fluidized) char bed at the lower section in the range of 1200° C. to 1500° C.

In more detail, by controlling the gas injection at the bottom portion such that an upwardly directed gas velocity within the gasification chamber is kept within e.g. the aforementioned interval of 0.1 to 2.0 m/s, the risk of distrupting/destroying the (fluidized) char bed, and consequently being forced to handle the residual char together with the generated and extracted synthesis gas, is reduced. Moreover, in embodiments where the at least one fuel-inlet comprises a feeding screw the feeding screw may be preheated by a pre-heating arrangement whereby the needed residence time of the particulate carbonaceous fuel within the gasification chamber can be reduced.

Further, preheating may be accomplished by using the fuel inlet, to inject a fuel together with an oxidant in order to provide for an exothermic reaction between the fuel and the oxidant. This exothermic reaction will thus pre-heat and the gasification chamber. As mentioned, an optional alternative for pre-heating is to pre-heat the particulate carbonaceous fuel and the oxidant in a feeding device such as e.g. screw feeder, i.e. before it is injected into the upper section via the fuel-inlet. The upwardly directed gas velocity may be measured and/or calculated by suitable means as readily appreciated by the skilled artisan (e.g. by sensory equipment and/or software simulations).

Even further, in yet another embodiment of the present invention, the gasification system further comprises a perforated grate located at said bottom portion, in order to facilitate extraction of residual ashes.

According to another aspect of the present invention, there is provided a method for gasifying carbonaceous material, where the method comprises:

providing a gasification chamber having an upper section and a lower section;

injecting a carbonaceous fuel and oxidant into the upper section of the gasification chamber whereby, in a thermochemical reaction, synthesis gas and residual char is generated;

extracting the synthesis gas from the upper section of the gasification chamber;

separating residual tar from the synthesis gas;

forming a char bed of the residual char in the lower section; and injecting the residual tar into the char bed.

With this aspect of the invention, similar advantages and preferred features are present as in the previously discussed first aspect of the invention, and vice versa.

Furthermore, in accordance with an embodiment of the invention, the method further comprises:

maintaining a temperature at the upper section of the gasification chamber in the range of 800° C. to 1100° C.; and maintaining a temperature of the char bed at the lower section of the gasification chamber in the range of 1200° C. to 1500° C.

In other words, the gasification chamber will have two zones or section with different temperatures, whereby an efficient gasification method with increased energy output can be achieved. The temperature in the upper section may for example over 900° C., and the temperature in the lower section and more specifically in the char bed may be over 1300° C.

These and other features and advantages of the present invention will in the following be further clarified with reference to the embodiments described hereinafter.

BRIEF DESCRIPTION OF THE DRAWINGS

For exemplifying purposes, the invention will be described in closer detail in the following with reference to embodiments thereof illustrated in the attached drawings, wherein.

DETAILED DESCRIPTION

Figure 1:
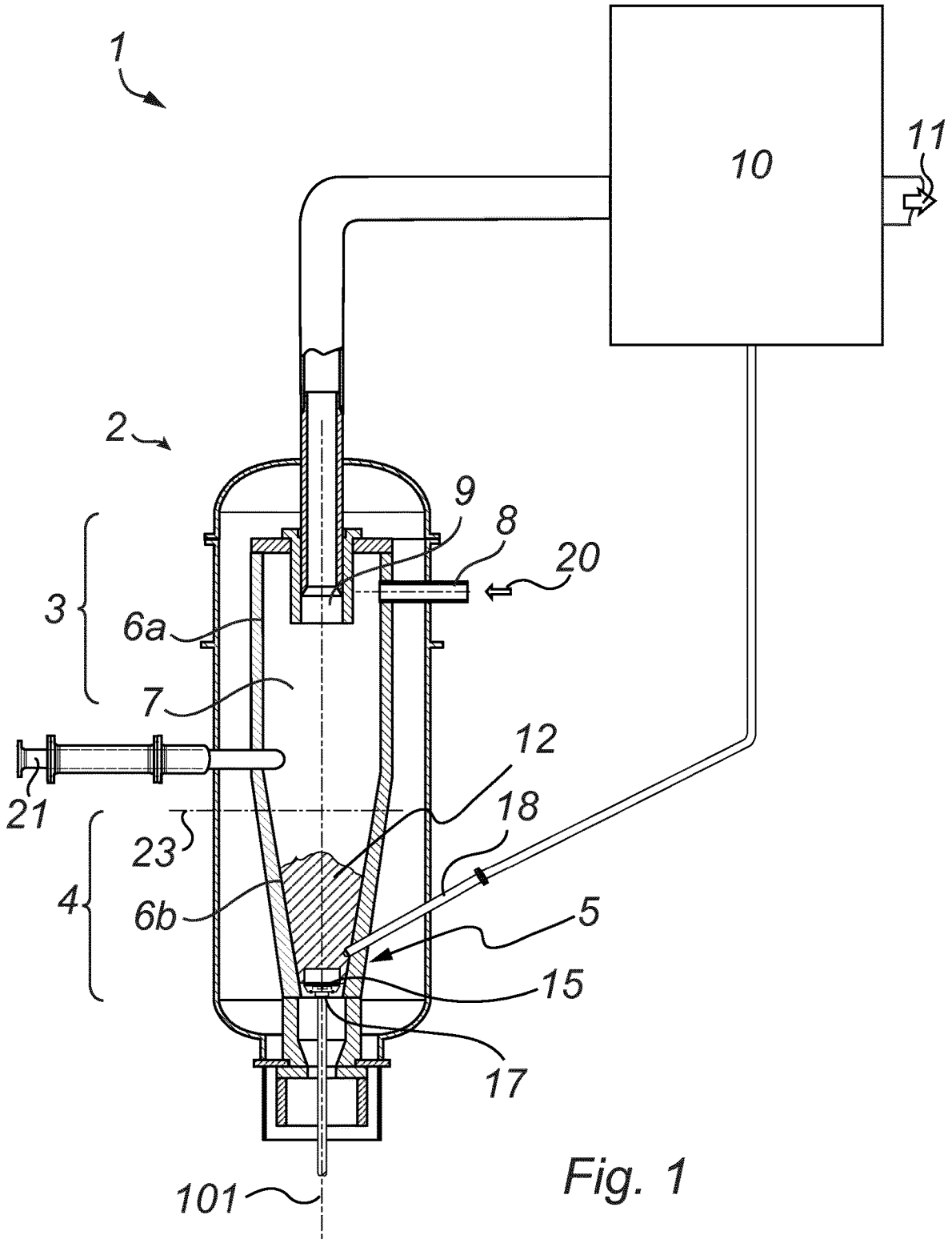
FIG. 1 is a schematic illustration of a gasification system in accordance with an embodiment of the present invention.

In the following detailed description, preferred embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well known constructions or functions are not described in detail, so as not to obscure the present invention.

In FIG. 1*a* schematic illustration of a gasification system 1 is provided. The gasification system 1 includes a gasification chamber 2 having an upper section 3 and a lower section 4. The gasification chamber can for example be made of a ceramic material. The height of the gasification chamber is preferably in the range of 2000 mm to 4000 mm and the outer diameter in the range of 500 mm to 3000 mm. The gasification chamber 2 is shown in a cross-sectional view, the cross section taken in a plane including an elongated axis 101 (z-axis in a cylindrical coordinate system where the gasification chamber is approximated as cylinder). Further, the gasification chamber 2 is preferably of a cylindrical shape, but may be of any shape having an internal cavity 7 without departing from the scope of the invention. The lower section 4 has an inner wall 6*b* arranged in a tapered cylindrical shape, the inner diameter of the (cylindrical) gasification chamber 2 decreasing towards a bottom portion 5 of the gasification chamber 2. Thus, in other words the upper section 3 can be said to comprise an inner wall 6*a* that is, at least partly curved, e.g. cylindrically shaped and the lower section 4 has an inner wall 6*b* that is, at least partly, conically shaped.

Further, the gasification system has at least one fuel inlet 8 for injecting a solid particulate carbonaceous fuel and an oxidant (indicated by arrow 20) into the upper section 3 of the gasification chamber 2. The particulate carbonaceous fuel can for example be cellulose particles, e.g. wood particles, having a diameter of less than 3000 μm, preferably less than 2000 μm and most preferably less than 1000 μm. The particulate carbonaceous fuel and the oxidant are then converted, by a thermo-chemical reaction, into synthesis gas and residual char at the upper section 3 within the gasification chamber 2.

The gasification system 1 further has a separator 10 (schematically illustrated) in fluid connection with the upper section 3 of the gasification chamber 2 via an outlet 9. The separator 10 is configured to separate residual tar from the synthesis gas produced in the gasification chamber 2. The separator 10 can for example be an oil scrubber arranged to direct the synthesis gas through an oil mist in order to remove the residual tar from the synthesis gas, such that a combustible gas 11 may be extracted. The combustible gas can subsequently be used in a combustion engine or a gas turbine for e.g. producing electricity. Alternatively, the separator can be a quench water circuit with a quench tower and a venture scrubber, where the quench tower cools the synthesis gas (which passes through a water mist in the quench tower) in order to condense residual tar, and the venture scrubber acts as a de-duster, removing small particulate matters.

Further, the gasification system 1 has a char bed 12 disposed in the lower section 4. The char bed is formed by residual char generated in the thermo-chemical reaction at the upper section 3, the residual char then being allowed to travel downwards within the gasification chamber 2 in order to form the char bed 12. The flow or movement of the residual char can either be controlled by injecting the particulate fuel and oxidant into the upper section such that a helical flow of the synthesis gas is formed and residual char is separated as in a cyclone separator within the gasification chamber 2. Alternatively, or additionally, an injection velocity of the injected gas (e.g. air) through or around the grate 15 disposed under the char bed 12 at the bottom section may be controlled such that a total upwardly directed gas velocity within the gasification chamber is limited so that a balance between the downwardly directed travelling of residual char from the upper section 3 and the upwardly directed gas flow is not disrupted. The gas-inlet 17 at the bottom portion of the lower section 4 is configured to inject gas (such as e.g. air) into the char bed in order to at least partly fluidize the char bed 12. In other words, the injected gas through or around the grate 15 may not have an injection velocity or gas velocity that is so high so that residual char within the gasification chamber 2 is blown upwards towards the outlet 9. The perforated grate 15 defines a supporting surface arranged at the bottom of the gasification chamber 2 in order to support a formation of the char bed 12. Stated differently, the supporting surface is arranged to allow a build-up of residual char at a bottom portion of the gasification chamber 2 in order to form a char bed. Thus, the supporting surface can be said to have a substantially planar extension with a normal vector extending generally along a vertical axis (naturally some tolerances and shape optimization are feasible). The fuel injection and the gas injection at the bottom will however be further discussed in reference to FIG. 2.

Even further, the gasification system 1 has a tar inlet 18 arranged to inject the residual char that was separated from the synthesis gas in the separator 10 into the fluidized char bed, whereby, in a catalytic/thermal cracking process, the residual tar is converted into synthesis gas. The char bed may also in some embodiments be semi-fluidized. In a semi-fluidized char bed, the char bed is allowed to "fluidize" at a (maximum) predefined height, indicated by the broken line 23. This is to be understood as that the top surface of the fluidizing char bed is arranged to be at a predefined "height" of the gasification chamber, or that the char bed 12 has a predefined maximum volume. The predefined height 23 is preferably set at a level right below where the risk of bed material (e.g. residual char particles) being pulled away from the char bed due to entrainment is low or minimal. Thus, if the char bed is allowed to fluidize (i.e. have a height or upper surface) above this predefined height an undesired entrainment of bed material may occur. However, the fluidization level or height of the fluidized char bed is preferably set as close as possible, albeit below, this predefined height, since one wants to maximize the size/volume of the char bed without passing the predefined height. The height or fluidization level is controlled by controlling the injection rate/gas velocity at the gas-inlet 17.

The tar inlet 18 is in fluid connection with the separator 10. Thus, any residual tar caught in the synthesis gas generated in the thermo-chemical process at the upper section 3 is utilized to generate more synthesis gas whereby the efficiency of the complete gasification system 1 is increased. Moreover, maintenance requirements are reduced since the amount of residual tar causing pipe-clogging or unwanted build-up in other parts of the gasification system is minimized.

Thus, it can be said that the upper section 3 of the gasification chamber forms a first reaction zone (where particulate carbonaceous fuel is gasified and synthesis gas is produced) and the lower section 4 of the gasification chamber forms a second reaction zone (where residual tar is cracked and more synthesis gas is produced).

Figure 2:
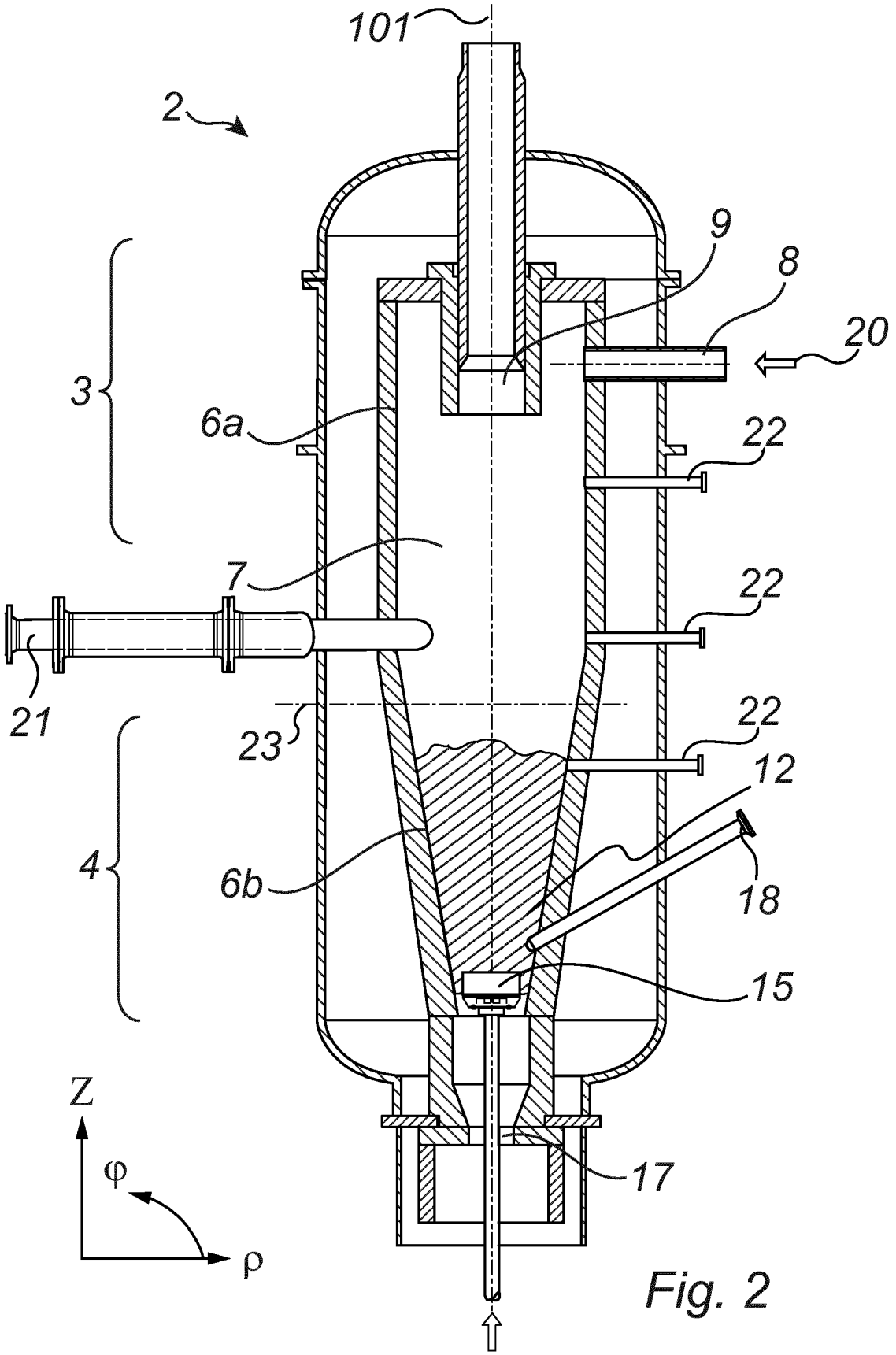
FIG. 2 is a schematic illustration of a gasification chamber in accordance with an embodiment of the present invention.

FIG. 2 shows a slightly enlarged illustration of the gasification chamber in FIG. 1. As previously discussed, the residual char generated in the thermo-chemical reaction at the upper section 3 is allowed to travel downwards within the gasification chamber in order to form the char bed 12. Thus, there is no need to handle the high temperature residual char in any process step outside the gasification chamber and the whole gasification system can be made more cost-effective.

The residual char can for example be separated by controlling the injection of particulate (carbonaceous) fuel and the oxidant into the gasification chamber 2 such that a vortex or cyclone separation is achieved. Such a gasification chamber can be referred to as an entrained flow reactor. In more detail, the particulate fuel and oxidant (sometimes referred to as mixture) can be injected with a velocity within the range of 20 m/s to 150 m/s. As mentioned, the injected flow is preferably substantially tangential with the inner surface 6*a* of the upper section and with a pitch, such that a downwardly spiralling swirling/helical flow of synthesis gas is created within the gasification chamber 2. Thus, along the swirling flow within the cavity 7 the gasification chamber 2 the mixture of particulate carbonaceous fuel and oxidant undergoes a thermo-chemical reaction and synthesis gas and residual char is produced. As a result of the swirling flows, the centrifugal force causes the residual char particles towards the inner walls 6*a*, 6*b* of the gasification chamber 2, allowing the residual char to be transported towards the lower section 4 and the bottom of the gasification chamber 2, where they form the char bed 12. The char bed 12 may, as mentioned, be semi-fluidized, i.e. have a maximum predefined top surface height, as indicated by the broken line 23. Furthermore, the gasification chamber 2 may be arranged with more than one fuel inlet, such that several parallel swirling flows may be created, thereby increasing the efficiency of the gasification system further, such a system is described in the currently unpublished European Patent Application No. 15163203.1 by the same application, incorporated herein by reference.

The gasification chamber 2 can for example be defined by cylindrical coordinates, i.e. the gasification chamber 2 has an extension in a radial direction p, an extension in an azimuth angle direction φ, and an extension in a z-direction being perpendicular to a (p, φ)-plane defined by the radial and azimuth angle directions. The fuel-inlet(s) 8 are then accordingly arranged to inject the particulate carbonaceus fuel (substantially) along the azimuth angle direction. Optionally, the fuel-inlet(s) may further be configured to also inject the carbonaceous fuel slightly downwards in a negative z-direction such that a downwardly spiraling flow is achieved. The spiraling flow being coaxial with respect to the exit pipe, forming the outlet 9, where the exit pipe has a central axis parallell to the z-direction.

Alternatively, or additionally the downwardly directed flow of residual char formed in the thermo-chemical process can be controlled by controlling the injection velocity of the gas injection through the gas-inlet 17 at the bottom portion of the lower section 4. By maintaining the upwardly directed gas velocity within the gasification chamber in the range between 0.1 m/s and 2.0 m/s the char bed can be fluidized without disrupting the downwardly directed flow of residual char (the residual char is formed by heavy particles in relation to the synthesis gas) such that the amount of residual char exiting the gasification chamber 2 through the outlet 9 is minimized/reduced and the extracted synthesis gas is kept substantially char-free. To some extent, the fluidized char bed can also be said to form an updraft gasifier where e.g. air is provided through the grate 15.

Further, bottom ash in the char bed may be evacuated from the gasification chamber 2 through a wet-ash system. The wet ash system comprises a set of injection nozzles (not shown) disposed at the bottom portion of the lower section 4 forming a water-ash mixture having a water-level at a bottom portion. The water-ash mixture can then be allowed to flow from the bottom portion, e.g. by periodically moving the grate 15 along the longitudinal axis 101 and collected in a tank (not shown) in fluid connection with the bottom portion. This wet-ash system can be used in order to control the size of the char bed or amount of residual char collected at the lower portion. The bottom grate 15 may be perforated, whereby the bottom ash may be evacuated via holes or perforations provided through the grate 15.

Even further, the gasification system can optionally comprise a feeding device 21 such as e.g. a feeding screw or feeding pump arranged to inject a carbonaceous fuel (solid or liquid) into the gasification chamber 2.

The perforated grate 15 located at the bottom portion may for example comprise a ceramic material or any other suitable material. Moreover, the gasification chamber 2 may be arranged with a set of temperature control inlets 22 or oxidant inlets 22. The temperature control inlets/oxidant inlets 22 are preferably spatially separated and distributed along a length (elongated axis 101) of the gasification chamber 2. A set in the present context can be one or more. The temperature control inlets 22 are configured to inject gas (such as e.g. air) into the gasification chamber in order to control the temperature within the gasification chamber 2 at various sections. By having a plurality of temperature control inlets 22 a temperature gradient can be formed within the gasification chamber 2, for example going from a highest temperature in the lower section 4 to a lowest temperature in the upper section 3. The temperature control inlets may also be operated as oxidant inlets for injecting oxidant (at various vertical levels) into the gasification chamber 2 in accordance with an embodiment of the invention. The oxidant inlets may accordingly also be used for temperature/process control.

Figure 3:
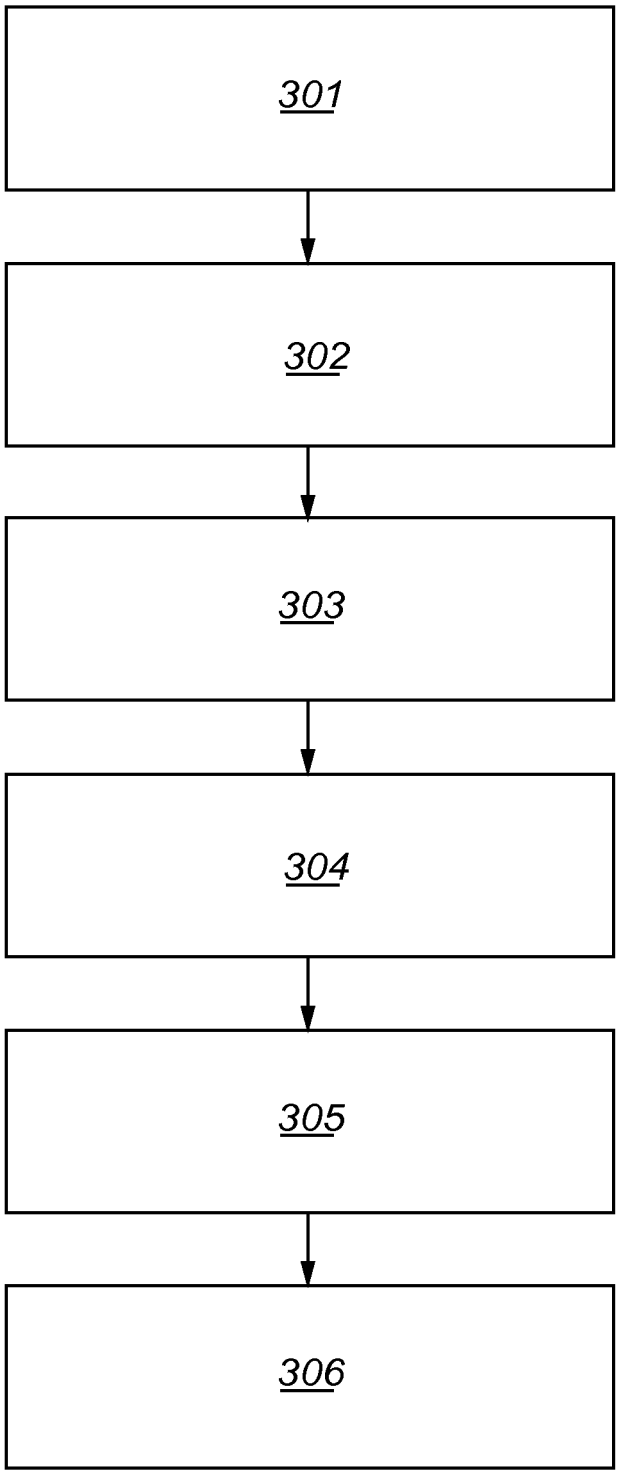
FIG. 3 is a schematic flow chart illustrating a method for gasifying carbonacous material in accordance with an embodiment of the present invention.

FIG. 3 illustrates a schematic flow chart describing a method for gasifying carbonaceous material in accordance with an embodiment of the present invention. The method comprises a step of providing 301 a gasification chamber having an upper section and a lower section. For example, a gasification chamber as described in reference to FIGS. 1 and 2. Next, a fuel containing carbonaceous material and an oxidant is injected 302 into the upper section of the gasification chamber, whereby, in a thermo-chemical reaction, synthesis gas and residual char is generated or produced. The carbonaceous fuel and oxidant may be injected separately through at least two separate inlets or concurrently through at least one common inlet. The synthesis gas is subsequently extracted 303 from the upper section of the gasification chamber, e.g. via an outlet provided at the upper section. Continuingly, a step of separating 304 residual tar(s)

from the synthesis gas is performed. The residual tar(s) can for example be separated by condensing the residual tar(s) in the synthesis gas, sedimentation, filtering or using a centrifuge. The method further includes forming 305 a char bed at the lower section of the gasification chamber. The char bed being formed 305 from the residual char collected within the gasification chamber. Subsequently, the separated tar(s) is/are injected 306 into the char bed.

The method may further comprise maintaining a temperature within the gasification chamber at the upper section in the range of 800° C.-1100° C., preferably in the range of 850° C.-1000° C. and more preferably in the range of 900° C.-950° C. Moreover, the method can also comprise a step of maintaining a temperature of the char bed at the lower section of the gasification chamber in the range of 1200° C.-1500° C. preferably in the range of 1250° C.-1400° C. and more preferably in the range of 1300° C.-1350° C. The temperature within the different sections or portions of the gasification chamber can for example be maintained (or controlled) by injection of oxidant into the gasification chamber via a set of temperature control inlets and/or the one or more gas inlets at the bottom portion.

The invention has now been described with reference to specific embodiments. However, several variations of the gasification system are feasible. For example, injections velocities may be varied within the intervals given in order to suit specific applications and carbonaceous fuel-types, as already exemplified. Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements.

The invention claimed is:

1. A gasification system comprising:

a gasification chamber having an upper section and a lower section;

at least one fuel-inlet for injecting carbonaceous fuel and oxidant into said upper section whereby, in a thermo-chemical reaction, synthesis gas and residual char is generated;

a separator in fluid connection with the upper section via an outlet, said separator being configured to receive said synthesis gas and to separate residual tar from said synthesis gas;

a char bed disposed in said lower section, said char bed being formed by residual char generated in said thermo-chemical reaction and allowed to travel downwards within said gasification chamber to the char bed;

at least one gas-inlet at a bottom portion of said lower section for injecting gas into said char bed;

at least one tar inlet arranged to inject said residual tar from said separator into said char bed whereby, in a cracking process, said residual tar is converted into synthesis gas, and a perforated grate located at said bottom portion, arranged to support a formation of the char bed and being movable in order to extract residual ashes;

wherein the lower section of the gasification chamber is adapted for a temperature higher than a temperature of the upper section of the gasification chamber, wherein said at least one gas inlet is configured to control an injection velocity of the injected gas such that a fluidization of said char bed does not disrupt a balance between the downwardly directed travelling of residual char from said upper section and an upwardly directed flow of gas, wherein said carbonaceous fuel is a solid particulate carbonaceous fuel, and wherein said upper section of the gasification chamber has a curved inner surface, and wherein said at least one fuel-inlet is configured such that said solid particulate carbonaceous fuel and oxidant is injected into said upper section tangentially such that an entrained flow of said synthesis gas is formed, whereby residual char is separated and allowed to travel from said upper section down towards said lower section in order to form the char bed.

2. The gasification system according to claim 1, wherein the gas injection through said at least one gas-inlet is arranged such that a gas velocity of said upwardly flowing gas within the gasification chamber is in the range from 0.1 m/s to 2.0 m/s whereby a fluidization of said char bed does not disrupt a balance between the downwardly directed travelling of residual char from said upper section and upwardly directed flow gas.

3. The gasification system according to claim 1, wherein said gasification chamber further comprises a set of temperature control inlets spatially separated and distributed along a length, extending between the lower section and the upper section, of said gasification chamber, wherein said set of temperature control inlet(s) is/are configured to inject gas into the gasification chamber whereby a process temperature within said gasification chamber is controlled.

4. The gasification system according to claim 1, wherein said at least one fuel inlet comprises a feeding device for injecting said carbonaceous fuel into said upper section, and wherein said gasification system further comprises at least one oxidant inlet, separate from said at least one fuel inlet, for injecting oxidant into said gasification chamber.

5. The gasification system according to claim 4, wherein said gasification system comprises at least two oxidant inlets spatially separated along a length, extending between said lower section and said upper section of said gasification chamber, for injecting oxidant into said gasification chamber.

6. The gasification system according to claim 5, wherein a rate of injected oxidant into said gasification chamber from said at least two oxidant inlets, is individually controllable.

7. A method for gasifying carbonaceous material comprising:

providing the gasification system according to claim 1;

injecting the carbonaceous fuel and oxidant into said upper section of the gasification chamber whereby, in a thermo-chemical reaction, synthesis gas and residual char is generated;

extracting said synthesis gas from said upper section of the gasification chamber;

separating residual tar from said synthesis gas;

forming a char bed of said residual char in said lower section; and injecting said residual tar into the chair bed.

8. The method according to claim 7, further comprising:

maintaining a temperature at said upper section of the gasification chamber in the range of 800° C. to 1100° C.; and maintaining a temperature of said char bed at said lower section of the gasification chamber in the range of 1200° C. to 1500° C.

* * * * *